US010335703B1

(12) United States Patent
Chiang

(10) Patent No.: US 10,335,703 B1
(45) Date of Patent: Jul. 2, 2019

(54) RING COMBINATION TOY

(71) Applicant: LI HSEN PLASTICS CO., LTD., New Taipei (TW)

(72) Inventor: San-Lang Chiang, New Taipei (TW)

(73) Assignee: LI HSEN PLASTICS CO., LTD., New Taipei (TW)

( * ) Notice: Subject to any disclaimer, the term of this patent is extended or adjusted under 35 U.S.C. 154(b) by 0 days.

(21) Appl. No.: 15/871,956

(22) Filed: Jan. 15, 2018

(51) Int. Cl.
*A63H 33/08* (2006.01)
*A63H 33/10* (2006.01)

(52) U.S. Cl.
CPC ..... *A63H 33/105* (2013.01); *A63H 33/088* (2013.01)

(58) Field of Classification Search
CPC ..... A63H 33/105; A63H 33/088
See application file for complete search history.

(56) References Cited

U.S. PATENT DOCUMENTS 6,231,416 B1 * 5/2001 Clever ..... A63H 33/082 446/108
2010/0122709 A1 * 5/2010 Janatpour ..... A45F 5/00 132/286

OTHER PUBLICATIONS https://hoosierhomemade.com/backyard-olympic-games/, Jul. 26, 2012, Liz.*

* cited by examiner

*Primary Examiner* — Eugene L Kim
*Assistant Examiner* — Jeffrey S Vanderveen
(74) *Attorney, Agent, or Firm* — Leong C. Lei

(57) ABSTRACT

A ring combination toy includes plural assembling bodies which are ring structures, each having plural first connecting portions; and plural assembling pieces, each having two connecting structures and a bent portion, and the connecting structures are connected by the bent portion to form the assembling piece, and each of the connecting structures has a second connecting portion corresponding to the respective first connecting portion. When the second connecting portions of any one of the assembling pieces is engaged to the first connecting portions of any two of the assembling bodies respectively, the assembling bodies are combined with the assembling pieces. Through the design of different shapes, the young children will not be injured easily while playing the game, and the parents can be assured to let their young children play the game and have fun freely.

15 Claims, 5 Drawing Sheets

RING COMBINATION TOY

FIELD OF THE INVENTION

The present invention relates to the field of combination toys, and more particularly to a ring combination toy that allows young kids to arrange and assembly a desired shape of the toy and has a less chance of being injured while playing the toy.

BACKGROUND OF THE INVENTION

1. Description of the Related Art

To cultivate children's special qualities such as creative thinking, imagination, and creativity, parents usually buy some toys that can be assembled or combined freely for children to play, and the common ones are puzzle plates and blocks.

In general, common puzzle plates are provided with a plurality of holes in a chassis, and a plurality of small parts in different shapes provided to be plugged into the holes to give a puzzle effect. However, such puzzle plates are limited by the volume of the chassis, so that the splicing range cannot be expanded further, and players cannot arrange some of the special shapes. As a result, the game is less interesting, and it is relatively more difficult to promote the players' creativity and imagination.

In addition, common blocks usually come with a small volume and most of them have rough edges and corners that may injury the young players accidently while playing the toy, so that parents have to keep an eye on the activities of their children all the time and cannot be assured to let their children play and have fun freely, and the parents also spend much time on watching their children unnecessarily.

In view of the aforementioned drawbacks, the inventor of the present invention based on years of experience to conduct extensive research and development, and finally provided a ring combination toy to overcome the drawbacks of the prior art.

2. Summary of the Invention

Therefore, it is a primary objective of the present invention to provide a ring combination toy that allows young children to play and have fun without being injured easily and parents to be assured that their children can play freely.

To achieve the aforementioned and other objectives, the present invention provides a ring combination toy comprising: a plurality of assembling bodies, each being a ring structure and having a plurality of first connecting portions; and a plurality of assembling pieces, each having two connecting structures and a bent portion, and the connecting structures being coupled to one another through the bent portion to form the assembling piece, and each of the connecting structures having a second connecting portion corresponding to the respective first connecting portion; wherein when the second connecting portions of any one of the assembling pieces are engaged with the first connecting portions of any two of the assembling bodies respectively, the assembling bodies and the assembling pieces are spliced together and provided for a user to combine.

With such ring design without having sharp edges and corners, the player will not be injured easily while playing the toy.

In addition, a limit portion is formed and protruded from an interval between the first connecting portions and provided for preventing the second connecting portions from sliding freely after they are engaged.

Preferably, a spherical stack piece is provided at a hollow ring position between any two of the assembling bodies for stacking the assembling bodies with each other while playing the toy, so as to change the mode of the present invention from a planar mode into a three-dimensional mode.

Preferably, each of the assembling bodies has an internal diameter from 30 mm to 35 mm, and each of the assembling bodies has a thickness from 35 mm to 40 mm, so as to prevent the upper and lower stacked spherical stack pieces from colliding with each other.

Preferably, each of the assembling bodies has an external diameter from 90 mm to 105 mm, and each of the assembling pieces has a length from 65 mm to 75 mm and a width from 50 mm to 55 mm, so as to prevent young children from swallowing the assembling bodies or assembling pieces by accident.

Preferably, each of the spherical stack pieces has a diameter from 55 mm to 70 mm, so as to prevent young children from swallowing the spherical sack pieces by accident.

In an embodiment, the second connecting portions are in a groove shape, and the second connecting portions have opposite opening directions, so as to provide a more diversified appearance of the toy after splicing.

In another embodiment, the second connecting portions are in a groove shape, and the second connecting portions have the same opening direction.

With the design of the volume and shape of the present invention, young children will not be injured easily while playing the toy or swallowing any part of the toy by accident, so that parents can be assured to let their young children play the toy and have fun freely, so as to further cultivate the players' imagination and creativity. The toy of the present invention may be played by combining the spherical stack pieces in a ball poll. Obviously, the present invention can provide a three-dimensional combination mode and a more diversify way of playing the toy, so as to further improve the recreation and fun of the game.

DESCRIPTION OF THE PREFERRED EMBODIMENTS

The above and other objects, features and advantages of this disclosure will become apparent from the following detailed description taken with the accompanying drawings.

Figure 1:
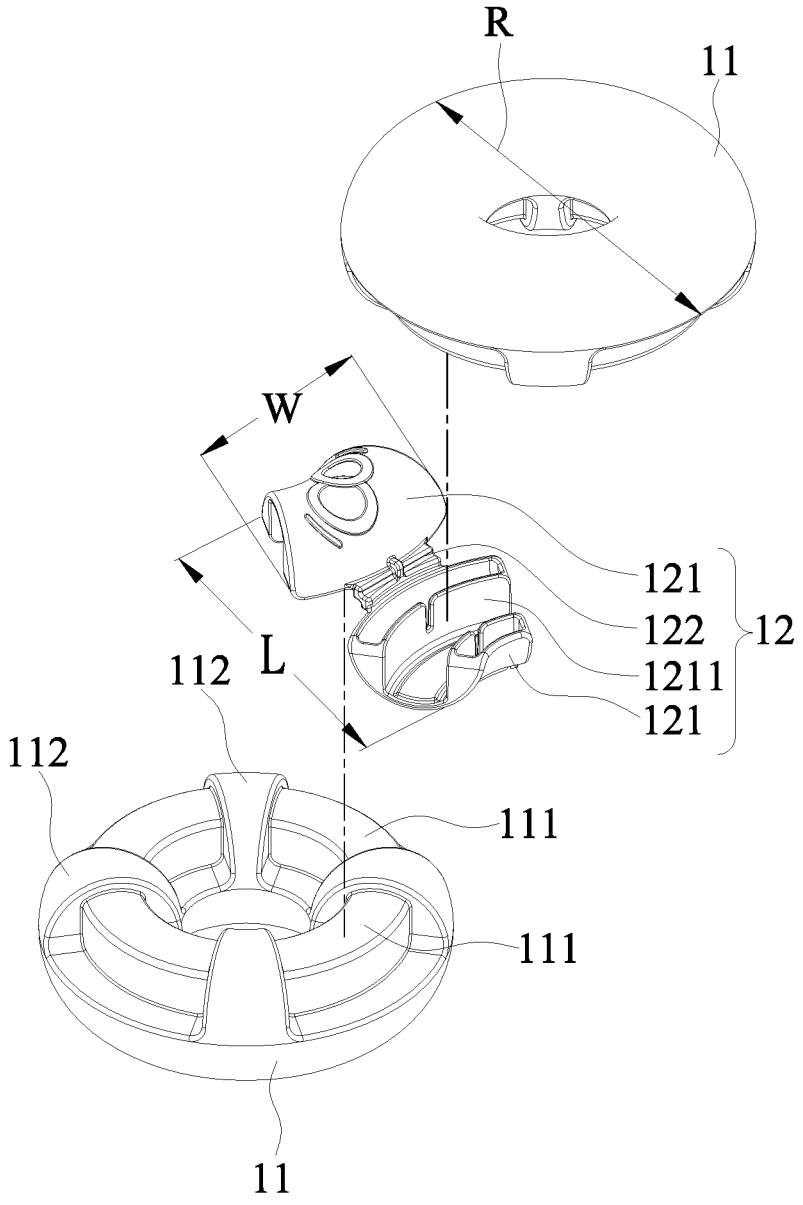
FIG. 1 is an exploded view of a first embodiment of the present invention.
Figure 2:
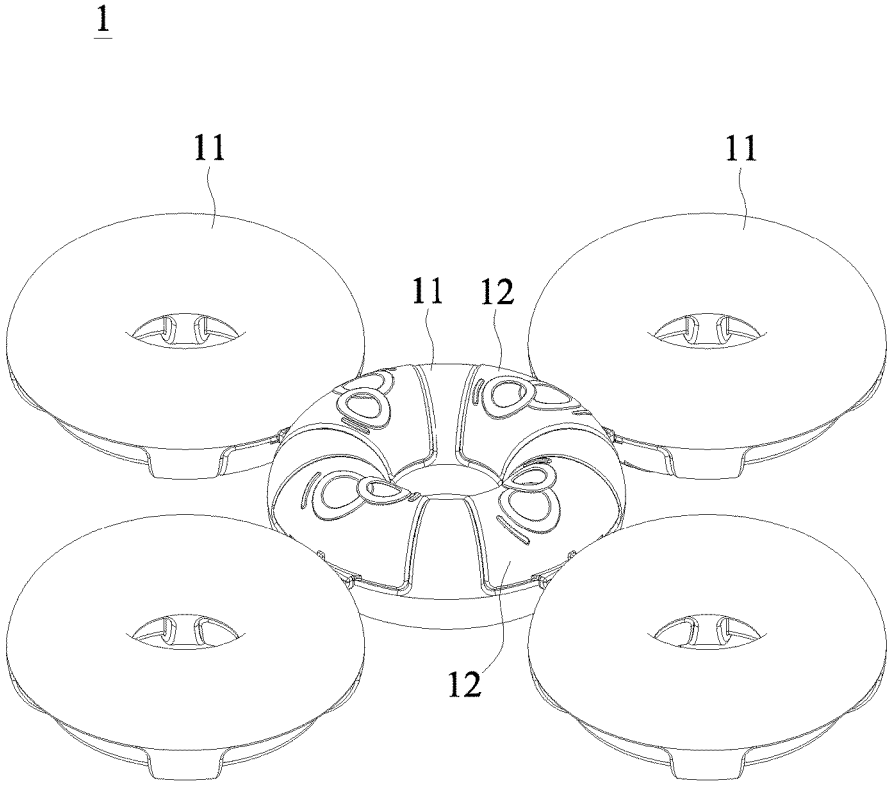
FIG. 2 is a schematic view of an application of the first embodiment of the present invention.

With reference to FIGS. 1 and 2 for an exploded view and a schematic view of a ring combination toy in accordance the first embodiment of the present invention respectively, the ring combination toy 1 comprises: a plurality of assembling bodies 11, being a ring structure, and preferably the assembling bodies 11 having an external diameter R from 90 mm to 105 mm, and each of the assembling bodies 11 having a plurality of first connecting portions 111; and a plurality of assembling pieces with a length L preferably from 65 to 75 mm, and a width W from 50 mm to 55 mm, and each of the assembling pieces 12 having two connecting structures 121 and a bent portion 122, and the connecting structures 121 being coupled with each other through the bent portion 122 to form the assembling piece 12, and each of the connecting structures 121 having a second connecting portion 1211 corresponding to the respect first connecting portion 111.

In this embodiment, the first connecting portions 111 are disposed with an interval apart from each other, and a limit portion 112 is formed and protruded from the interval between the first connecting portions 111, and the second connecting portions 1211 is in a groove shape, and the second connecting portions 1211 have opposite opening directions.

During use, young children may engage the second connecting portions 1211 of any one of the assembling pieces 12 with the first connecting portions 111 of any two of the assembling bodies 11 respectively to combine the assembling bodies 11 with the assembling pieces 12 to produce various different shapes or patterns. With the limit portions 112, the assembling bodies 11 and the assembling pieces 12 can be combined more securely and cannot be slid to ruin the overall combined structure as shown in FIG. 2. With the special design of volume, the young children cannot put any one of the assembling pieces 12 or any one of the assembling bodies 11 into their mouth or swallow the assembling piece 12 or assembling body 11 by accident. In addition, the whole structure of the assembling bodies 11 is a ring structure, and the assembling pieces 12 are designed with an arc guiding angle, so that the young children will not be injured easily while playing the toy, so as to improve the safety of the game significantly.

Figure 3:
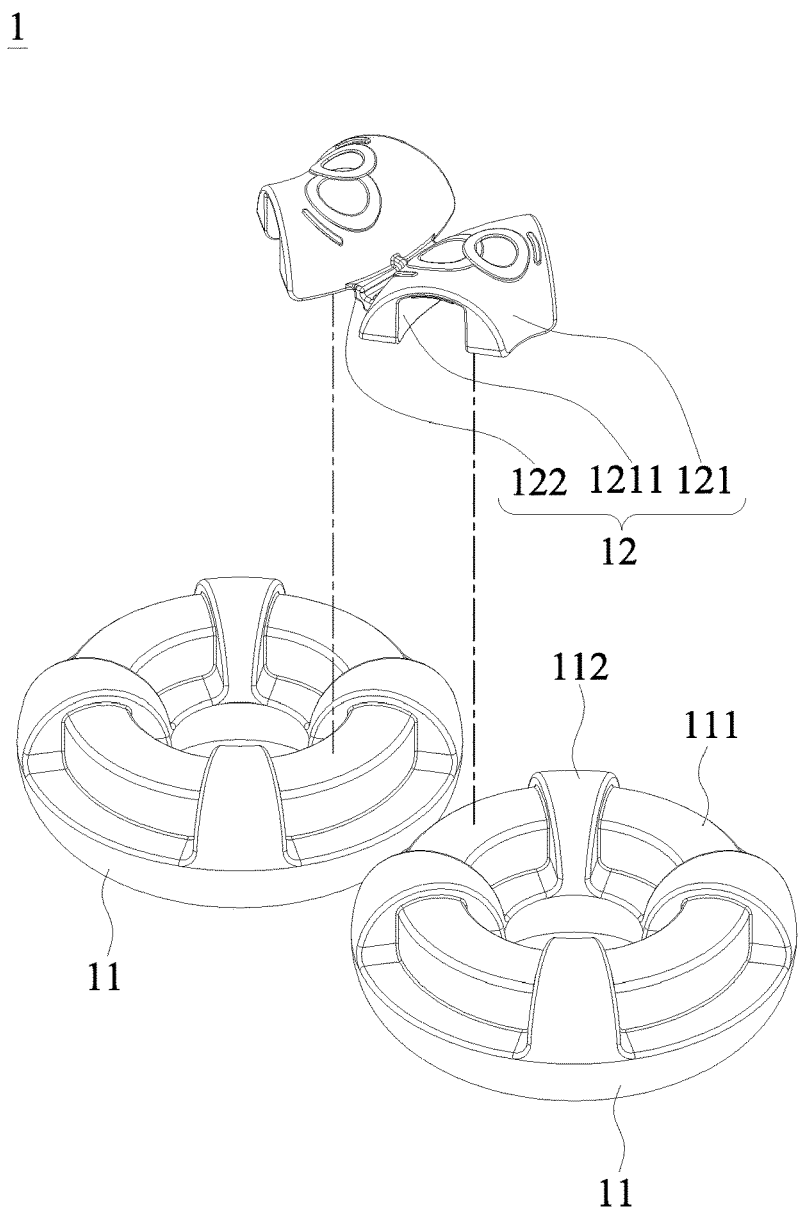
FIG. 3 is an exploded view of another implementation mode of the first embodiment of the present invention.

With reference to FIG. 3 for an exploded view of another implementation of the first embodiment of the present invention, the difference between this implementation mode and the previous implementation mode resides on that the second connecting portions 1211 are in a groove shape, and the second connecting portions 1211 have the same opening direction, so that the splicing direction is as shown in the figure, and the splicing pattern varies. As a result, the young children can enjoy the game by assembling the parts of the toy through different assembling directions.

Figure 4:
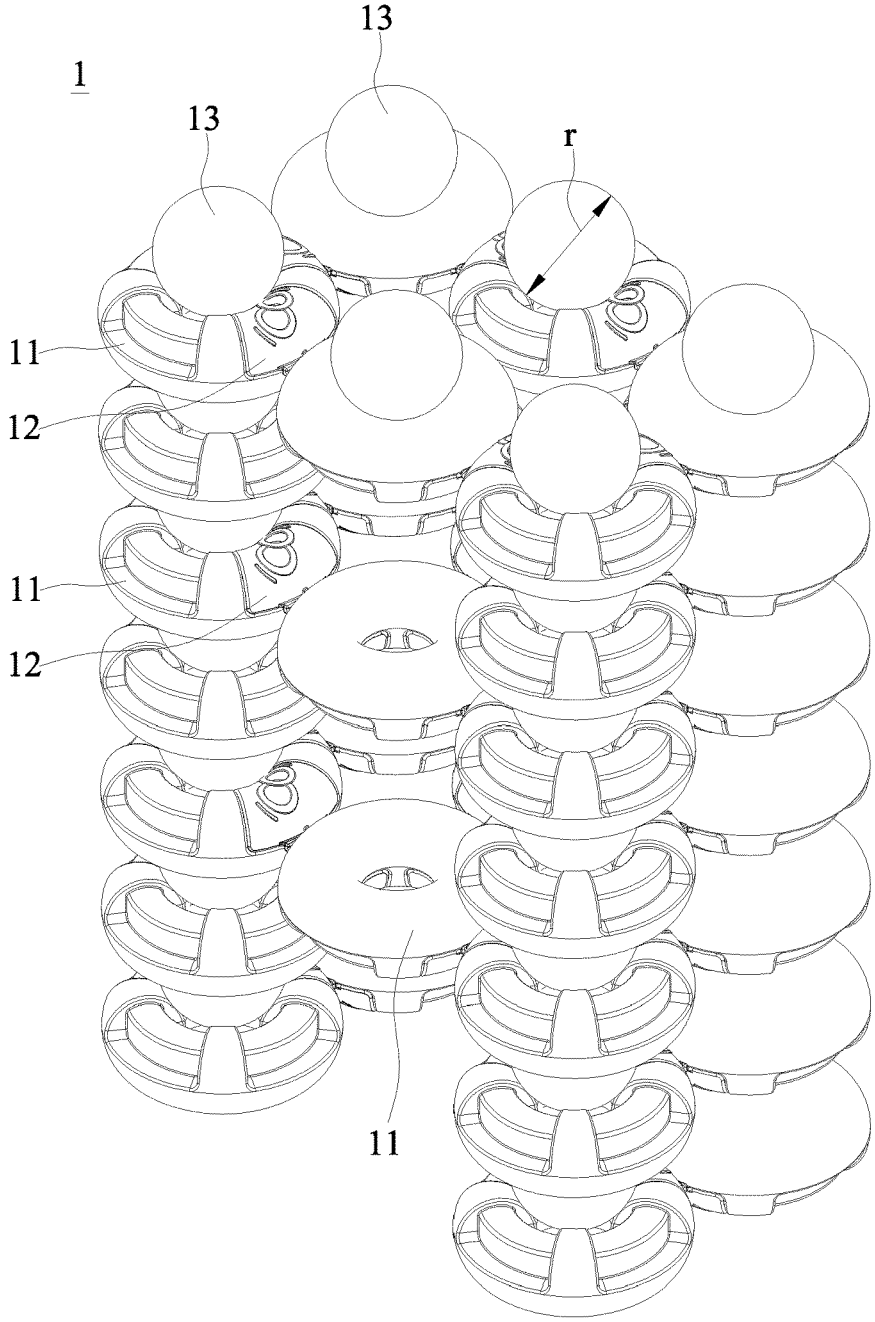
FIG. 4 is a schematic view of an application of a second embodiment of the present invention.
Figure 5:
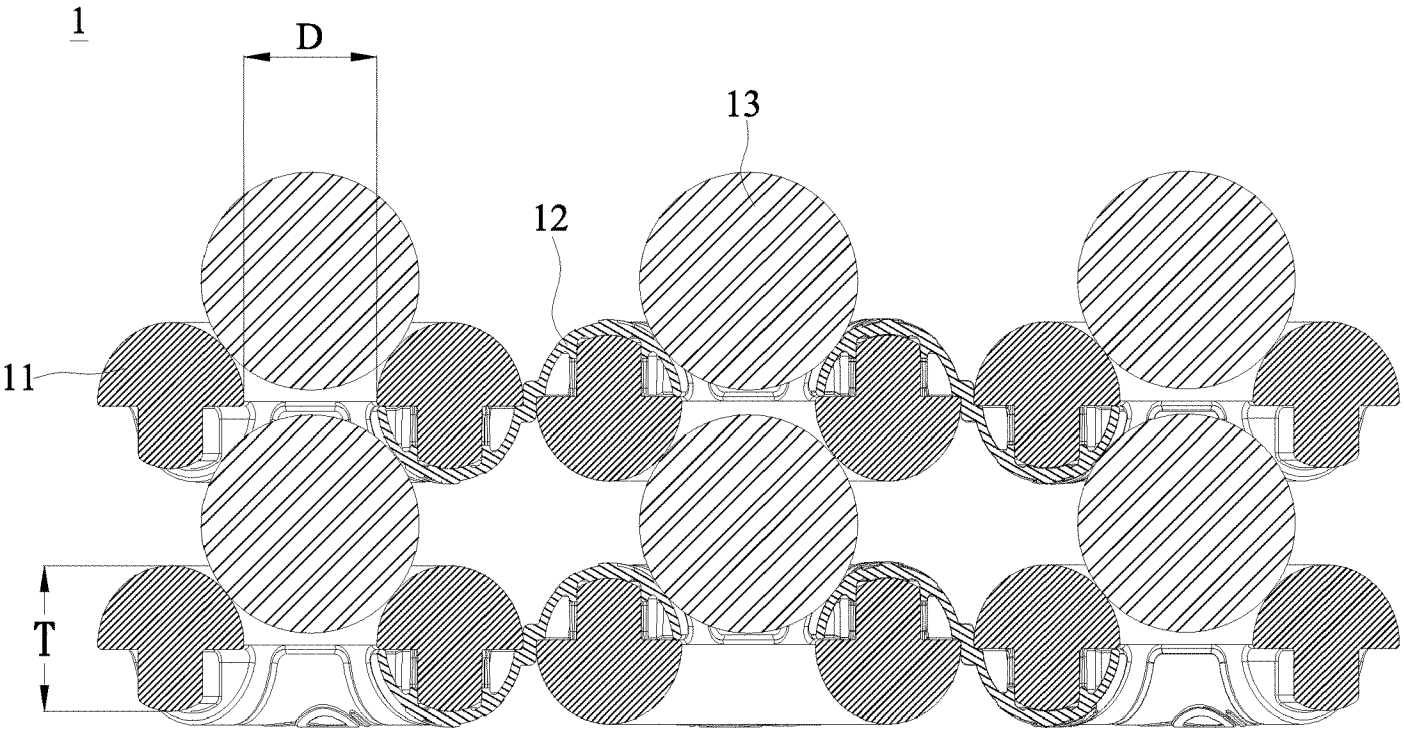
FIG. 5 is a partial sectional view of the second embodiment of the present invention.

With reference to FIGS. 4 and 5 for a schematic view and a partial sectional view of the second embodiment of the present invention respectively, the difference between this embodiment and the first embodiment resides on that a spherical stack piece 13 is provided at a hollow ring position between any two of the assembling bodies 11 for stacking the assembling bodies 11 with one another. For example, FIG. 4 shows that the assembling bodies 11 are stacked to form a tower, wherein each of the spherical stack pieces 13 has a diameter r from 55 mm to 70 mm to prevent young children from swallowing the spherical stack pieces 13 by accident. In addition, each of the assembling bodies 11 is designed with an internal diameter D from 30 mm to 35 mm and a thickness T from 35 mm to 40 mm, so as to effectively prevent the upper and lower stacked spherical stack pieces 13 from colliding with each other, and to provide a better stacked status.

With this arrangement, young children may use the spherical stack pieces 13 in a ball pool to play the game, or use the spherical stack pieces 13 to create different shapes or forms of the toy, so that the present invention has the effects of providing young children a more diversified way of playing the toy, making the concept of the three-dimensional space more profound to young children while playing the game, and expanding the imagination and creativity of the young children.

In summation of the description above, the present invention surely provides a ring combination toy 1 which is safe to play with and capable of preventing the young children from swallowing the parts of the toy by accident. In addition, the invention indirectly improves the imagination, creativity, and the spatial concept of the young children while playing the toy and having fun.

What is claimed is:

1. A ring combination toy, comprising:

a plurality of assembling bodies, each being a ring structure and having a plurality of first connecting portions; and a plurality of assembling pieces, each having two connecting structures and a bent portion, and the connecting structures being coupled to one another through the bent portion to form the assembling pieces, and each of the connecting structures having a second connecting portion corresponding to the respective first connecting portion;

wherein when the second connecting portions of any one of the assembling pieces are engaged with the first connecting portions of any two of the assembling bodies respectively, the assembling bodies and the assembling pieces are spliced together and provided for a user to combine, wherein the first connecting portions are disposed with an interval apart from each other, and a limit portion is formed and protruded from the interval between the first connecting portions, wherein the ring combination toy further comprises a spherical stack piece disposed at a circular hollow position for stacking the assembling bodies with each other at a hollow ring position between any two of the assembling bodies when playing the toy.

2. The ring combination toy of claim 1, wherein the assembling bodies have an internal diameter from 30 mm to 35 mm, and the assembling bodies have a thickness from 35 min to 40 mm.

3. The ring combination toy of claim 2, wherein the assembling bodies have an external diameter from 90 mm to 105 mm, and the assembling pieces have a length from 65 mm to 75 mm and a width from 50 mm to 55 mm.

4. The ring combination toy of claim 2, wherein the second connecting portions are in a groove shape, and the second connecting portions have opposite opening directions.

5. The ring combination toy of claim 2, wherein the second connecting portions are in a groove shape, and the second connecting portions have the same opening direction.

6. The ring combination toy of claim 3, wherein the spherical stack pieces have a diameter from 55 mm to 70 mm.

7. The ring combination toy of claim 3, wherein the second connecting portions are in a groove shape, and the second connecting portions have opposite opening directions.

8. The ring combination toy of claim 3, wherein the second connecting portions are in a groove shape, and the second connecting portions have the same opening direction.

9. The ring combination toy of claim 6, wherein the second connecting portions are in a groove shape, and the second connecting portions have opposite opening directions.

10. The ring combination toy of claim 1, wherein the second connecting portions are in a groove shape, and the second connecting portions have opposite opening directions.

11. The ring combination toy of claim 1, wherein the second connecting portions are in a groove shape, and the second connecting portions have opposite opening directions.

12. The ring combination toy of claim 1, wherein the second connecting portions are in a groove shape, and the second connecting portions have opposite opening directions.

13. The ring combination toy of claim 1, wherein the second connecting portions are in a groove shape, and the second connecting portions have the same opening direction.

14. The ring combination toy of claim 1, wherein the second connecting portions are in a groove shape, and the second connecting portions have the same opening direction.

15. The ring combination toy of claim 1, wherein the second connecting portions are in a groove shape, and the second connecting portions have the same opening direction.

* * * * *